United States Patent [19]

Wolf et al.

[11] Patent Number: 4,554,435

[45] Date of Patent: Nov. 19, 1985

[54] ELECTRIC ARC HEATER HAVING OUTLET GAS ADMISSION

[75] Inventors: Charles B. Wolf, Irwin; Joseph W. George, Blairsville, both of Pa.

[73] Assignee: Westinghouse Electric Corp., Pittsburgh, Pa.

[21] Appl. No.: 553,340

[22] Filed: Nov. 18, 1983

[51] Int. Cl.[4] ..... H05B 7/18

[52] U.S. Cl. ..... 219/383; 219/121 P; 373/18

[58] Field of Search ..... 219/383, 121 P, 121 PL, 219/121 PR; 373/18, 22

[56] References Cited

U.S. PATENT DOCUMENTS

| | | | |
|---|---|---|---|
| 3,839,618 | 10/1974 | Muehlberger | 219/121 PL |
| 4,042,802 | 8/1977 | Fey | 219/121 P |
| 4,127,760 | 11/1978 | Meyer | 219/121 PL |
| 4,214,736 | 7/1980 | Wolf | 266/200 |
| 4,219,726 | 8/1980 | Meyer | 219/383 |

FOREIGN PATENT DOCUMENTS

| | | | |
|---|---|---|---|
| 939894 | 1/1974 | Canada | 219/121 P |

*Primary Examiner*—C. L. Albritton

*Assistant Examiner*—Teresa J. Walberg

*Attorney, Agent, or Firm*—John Victor Pezdek

[57] ABSTRACT

An electric arc heater having outlet gas admission. The mounting flange of an electric arc heater has a channel extending about its circumference which is enclosed by a detachably fastened plate to form a manifold. A passageway for the material to be admitted is provided between an outer surface of the mounting flange and the manifold. A plurality of peripherally spaced passageways are provided in the plate intermediate the manifold and the flow path of the arc heated gas exiting the arc heater outlet providing for the uniform distribution of the added material into the arc heated gas. By varying the position of these passageways a broad range of admission paths ranging from substantially parallel to the flow path of the arc heated gas to substantially perpendicular can be achieved without the use of additional downstream admission collars and seals. An annular gap can be provided between the plate and flange intermediate the peripherally spaced passageways and the flow path of the arc heated gas, the gap width controlling the flow rate of the material being added, preferably at sonic velocity.

13 Claims, 7 Drawing Figures

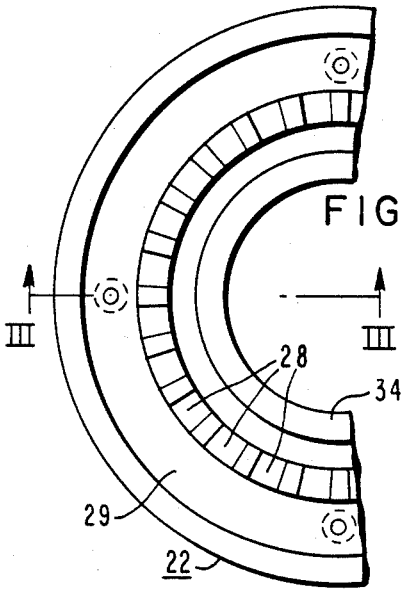
FIG. 2
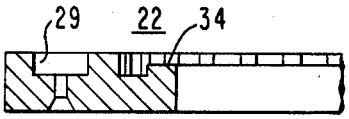
FIG. 3
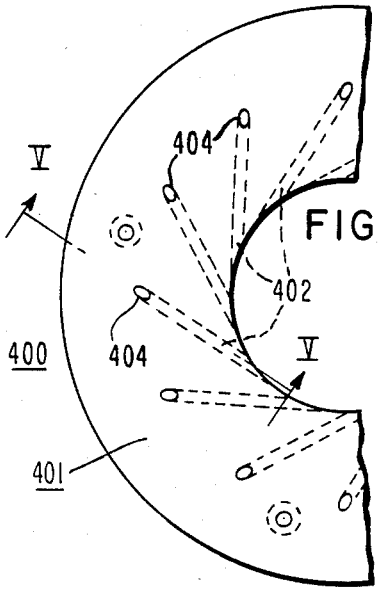
FIG. 4
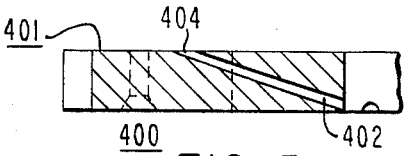
FIG. 5
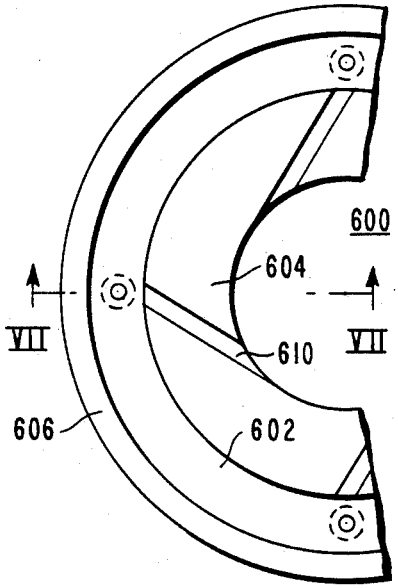
FIG. 6
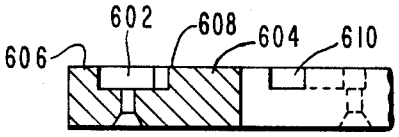
600 FIG. 7

ELECTRIC ARC HEATER HAVING OUTLET GAS ADMISSION

BACKGROUND OF THE INVENTION

1. Field of the Invention

The present invention relates to electric heating devices and in particular, electric arc heaters, also known as plasma heaters.

2. Description of the Prior Art

Electric arc or plasma heaters are used in industrial processes requiring the heating of process gas or materials to high temperatures. The high temperature product exiting the heater has many useful applications in the reduction of ores and in various other chemical processes. The electric arc heater can be electrically powered from either an AC source or a DC source and have electrical power level requirements typically exceeding 1000 kilowatts. In operation, an electric arc is generated between two electrodes in the electric arc heater. The gas or material to be heated is injected into the arc heater where it contacts the electric arc and is heated to an extremely high temperature.

Present electric arc heater designs incorporate at least two cylindrical electrodes which are axially spaced apart to form an annular arc gap across which the electric arc is formed. Rings constructed of insulating materials are positioned between the two electrodes and are used to maintain the arc gap. The electrodes are connected to a source of electric potential of sufficient magnitude to start and maintain the electric arc. The material to be heated, usually a gas, is injected into the arc gap causing the electric arc to lengthen into the arcing chamber which is an area defined by the interior surfaces of the electrodes. The intense heat contained in the electric arc is transferred to the material as it passes through the arcing chamber. The heated material is the exhausted from the electric arc heater into a reaction vessel wherein the arc heated material undergoes further reaction or heats or reacts with other material present in the reaction vessel.

A further refinement of the electric arc heater provides for the addition of field coils surrounding each electrode. These field coils are connected to a source of electrical potential to establish a magnetic field which interacts with the current flowing in the electric arc according to Lenz's Law causing the electric arc to rotate about the interior surfaces of the electrodes. Electric arc rotation decreases the rate of electrode erosion and allows for better temperature distribution in the electrode. In addition, channels are provided in the electrode assembly and field coils for water-cooling of the electric arc heater.

Examples of electric arc heaters employing these various elements can be found in U.S. Pat. No. 3,705,975 entitled "Self Stabilizing Arc Heater Apparatus" issued Dec. 12, 1972, U.S. Pat. No. 4,042,802 entitled "Three Phase Arc Heater" issued Aug. 16, 1977, U.S. Pat. No. 4,214,736 entitled "Arc Heater Melting System" issued July 29, 1980 and U.S. Pat. No. 4,219,726 entitled "Arc Heater Construction With Total Alternating Current Usage" issued Aug. 26, 1980. These patents are assigned to the assignee of the present invention and are examples of electric arc heaters that can be modified to use the present invention.

Although the electric arc heater can be used as an independent device, it is typically mounted on a reaction vessel such as a furnace, cupola or kiln. One mounting means used is a flange about the outlet of the electric arc furnace. A corresponding mating flange against which this outlet flange abuts is provided on the reaction vessel. The two flanges are secured together by bolts or other conventional fastening means. In lieu of the mating flange, the outlet flange of the electric arc heater can be attached directly to the surface of the reaction vessel by conventional means.

With present designs, when the downstream addition of another material to the arc heated material is desired, a cylindrical admission collar is positioned intermediate the outlet of the electric arc heater and the reaction vessel. The additional material enters the flow path of the arc-heated material exiting the outlet via passageways provided in the collar wall. Because of the high temperatures present, the admission collar is either refractory lined or is water-cooled, and is a separate part requiring special design and handling, separate, assembly and maintenance, and usually separate water cooling means. Additional sealing must also be provided to prevent leaks into or from the reactor. Accordingly, it would be advantageous to provide for downstream admission of additional material into the arc-heated material without the use of separate admission collars and seals.

When the electric arc heater is attached to the reaction vessel, it has been found that the surfaces of the passageways through which the arc-heated material is conducted into the reaction vessel suffer thermal and erosive damage from their contact with the hot materials. Depending upon the nature of the hot materials passing from the electric arc heater, it has also been found that undesirable materials can accumulate on these surfaces downstream of the outlet of the electric arc heater. Therefore, it would be desirable to have a means for preventing or ameliorating the erosive damage caused by the hot materials exiting the arc heater, as well as preventing buildup of undesirable material on the surfaces of the passages downstream of the electric arc heater.

SUMMARY OF THE INVENTION

In order to provide for the admission of materials downstream of the electric arc heater, the mounting flange thereof is provided with a substantially circumferential annular channel in its mating surface. A plate is detachably fastened to the mounting flange and encloses a channel to form a manifold. A passageway is provided between the outer surface of the flange and the manifold. The material, which is to be injected into the flow path of the arc heated gas exiting the arc heater, is conducted through this passageway into the manifold where it is distributed about the periphery of the electric arc heater outlet. A plurality of peripherally spaced passageways are provided for conducting the material from the manifold into the flow path of the arc heated gas exiting the outlet of the arc heater. These peripherally spaced passageways can be provided in the plate in the flange or they can be formed when the plate and flange are fastened together from radially oriented grooves provided in the mating surfaces of the flange or plate. In one embodiment of the invention, these peripherally spaced passageways are positioned such that the material passing therethrough enters the flow path of the arc heated gas in a direction which is substantially tangential thereto. In an alternate embodiment, these passageways are positioned such that the material enters the flow path of the arc heated gas in a direction which is substantially parallel thereto. These arrrangements of the peripherally spaced passageways permit either turbulent mixing of the arc-heated gas and the added material, or the formation of a boundary layer of the material about the arc heated gas, respectively. Tangential entry would be used where it is desired, for example, to cool the arch heated gas or to react the added material with the arc heated gas. The use of the boundary layer also known as sheet flow would be used to prevent undesirable material from collecting and building up on the surfaces of the passageways through which the arc-heated gas is conducted. Control of the flow rate of the material to be added can be obtained by varying the sizing of the passageways. In another embodiment of the invention in addition to the peripherally spaced passageways, a lip is provided on the mating surface face of the plate proximate the inner diameter thereof. When the plate is fastened to the mounting flange, an annular gap is formed between the lip and the flange. By varying the width of this gap, the flow rate of the material being added can be controlled.

Other uses for the invention include providing a means of uniformly admitting a gaseous material that is to react chemically with the heated gas exiting the arc heater or regulating the temperature of the heated gas stream to a desired value by adding a cold gas in the appropriate amount.

BRIEF DESCRIPTION OF THE DRAWINGS

FIG. 2 illustrates an alternate embodiment of the manifold cover plate which is used to create the boundary layer or sheet flow;

FIG. 3 is a cross-sectional view of the manifold cover plate shown in FIG. 2 taken along line III—III.

FIG. 4 is an illustration of the manifold cover plate having tangentially positioned passageways;

FIG. 5 is a cross-sectional view of the cover plate shown in FIG. 4 taken along line IV—IV;

FIG. 6 is an illustration of a manifold cover plate showing an alternate embodiment providing tangentially positioned peripheral passageways; and FIG. 7 is a cross-sectional view of the mainfold cover plate shown in FIG. 6 taken along the VII—VII.

Figure 1:
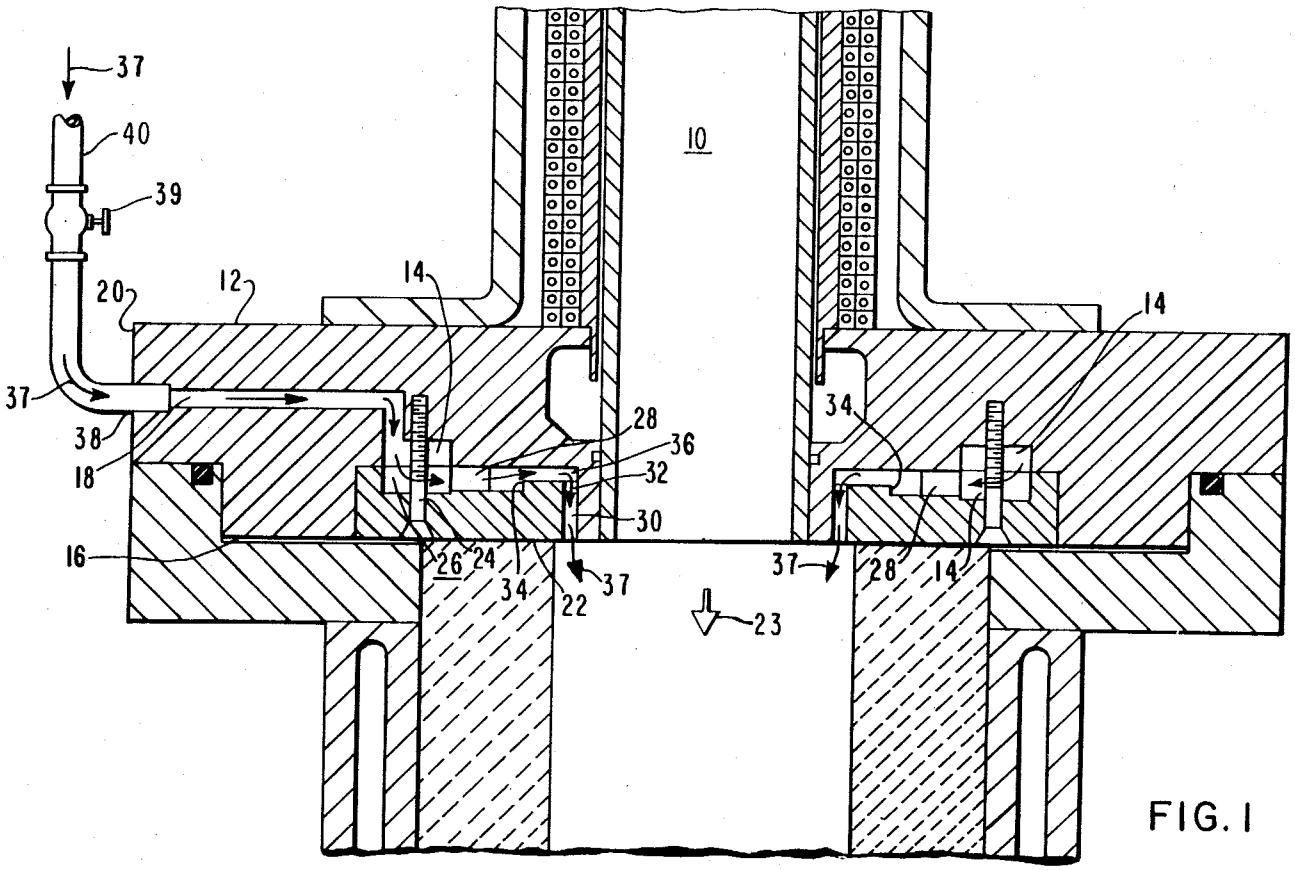
FIG. 1 is a partial cross-sectional view of the outlet of an electric arc heater embodying the present invention.

Because the embodiments of the invention are substantially symmetrical about the center line of the electric arc heater only one-half of the devices has been shown.

DESCRIPTION OF THE PREFERRED EMBODIMENT

Referring to FIG. 1, the outlet 10 of an electric arc heater embodying the present invention is shown in a partial cross-sectional view. A mounting flange 12 is disposed about the outlet 10 and is detachably secured thereto by conventional means not shown. A channel 14 is provided in the mating face 16 of the mounting flange 12 and circumferentially extends about a substantial portion thereof and, preferably, the entire circumference. A passageway 18 which extends between an outer surface 20 of the mounting flange 12 and the channel 14 is provided for conducting the material to be added into the channel 14. The course and size of the passageway 18 is determined by the mounting arrangement used for the electric arc heater and the desired flow rate for the material to be added.

A plate 22, preferably annular in shape, is detachably secured to the mating surface 16 of the mounting flange 10 by conventional fastening means 24 such as screws or bolts and encloses the channel 14 to form a manifold 26. A plurality of peripherally spaced passageways 28 are provided in the plate 22 extending between the manifold 26 and the flow path of the arc-heated gas which is designated by the heavy arrow 23. The manifold cover plate 22 is dimensioned such that when attached to the mounting flange 12, an annular gap 30 having an L-shaped cross-section is formed therebetween proximate the outlet 10 of the electric arc heater. The L-shaped cross-section for the gap 30 allows for the introduction of the added material in a direction substantially parallel to the flow path of the arc heated gas to create a boundary layer of added material about the the arc heated gas. It can be seen that by modifying the cross-sectional shape of the channel 14 or preferably the plate 22 the shape of cross-section of the gap 30 will change, making possible various paths for the introduction of the material to be added to the flow path of the arc-heated gas.

Flow control of the material being added can be accomplished by varying the width of the gap 30. Changing the inner diameter of the plate 22 which increases or decreases the width of the leg 32 of the L-shaped gap 30 is one means. Another means is to provide a lip 34 proximate the innner edge of the plate 22. The lip 34 projects toward the channel 14 but is spaced therefrom to form an annular opening which would correspond to the foot 36 of the L-shaped gap 30 shown in FIG. 1. By controlling the width of this annular opening, the flow rate of the material exiting from the manifold 26 into the flow path of the arc heated gas can be controlled. Preferably, when a gas is being added, this annular opening is dimensioned such that the flow of the added gas is at sonic velocity; thus, ensuring the essentially complete distribution of the added gas about the periphery of the outlet 10.

During operation of the electric arc furnace, a source of fluid 37, preferably a gas, is attached to the outer end 38 of the passageway 18 which communicates with the manifold 26. The fluid gas 37 passes through the passageway 18 into the manifold 26 from where it is distributed about the periphery of the outlet 10. The fluid 37 passes through the plurality of peripherally spaced passageways 28 and into the annular L-shaped gap 30 exiting at high velocity therefrom in a direction substantially parallel to the flow path of the arc heated gas 23. A value 39 may be provided in the line 40 supplying the fluid 37 to the passageway 18 to shut off the fluid 37 when not required and to prevent the back flow of arc heated gas through the various passageways. In the alternative, when downstream admission is not necessary, the line 40 may be disconnected with a plug (not shown) inserted into the outer end 38 of the passageway 18 to prevent back flow.

The plate 22 is shown in FIG. 1 as being recessed into the channel 14. However, the inner and outer diameters of this plate can be dimensioned to substantially coincide with the inner and outer diameters of the mounting flange 12. In order to achieve sheet flow with this arrangement a slot would be provided through the plate between the manifold 26 and the flow path of the arc heated gas 23 with the width thereof controlling the flow rate of the added material. The slot would be used in lieu of the L-shaped gap 30. The plate 22 shown in FIG. 1 is more fully illustrated in FIGS. 2 and 3. The plurality of peripherally spaced passageways 28 communicating between the manifold 26 and the inner edge of the plate 22 can be more clearly seen. As shown in these figures, a circular channel 29 is provided in the mating surface of the plate 22 intermediate the passageways 28 and the outer edge of the plate 22. This channel 29 forms part of the manifold 26 when the plate 22 is fastened to the flange 12. When the channel 29 is used. its shape is dependent upon the plate used and the cross-sectional shape of the channel 14 in the flange 12. Various shapes of plates with or without channels can be employed in practicing the invention.

In FIGS. 4 and 6, alternate embodiments of a plate providing for the tangential entry of the added material into the arc heated gas stream are shown. In FIGS. 4 and 5, the plate 400 has a plurality of tangentially positioned passageways 402 extending downwardly therethrough from the mating surface 401 and opening into the flow path of the arc heated gas. The upper opening 404 of these passageways 402 communicates with the manifold formed by the attachment of the plate to the mounting flange of the electric arc heater. In FIG. 6 the plate 600 has a substantially circular channel 602 therein forming an inner lip 604 and an outer lip 606 on the mating surface 608. A plurality of tangentially spaced passageways 610 are provided in the inner lip 604 extending between the channel 602 and the inner edge of the plate 600.

The material passing through the passageways 402 of the plate 400 shown in FIG. 4 would have components of velocity which would be tangential to as well as parallel with the flow path of the arc heated gas whereas the material passing through the passageways 610 shown in FIG. 6 would have components of velocity substantially tangential and perpendicular to the flow path of the arc heated gas. Although the plate 600 can be used with the U-shaped channel 14 shown in FIG. 1, preferably an L-shaped channel is provided in the flange so that the perpendicular component of velocity of the material being added is maximized. It will be appreciated that the flow rate of the material being added can be controlled by the number of and/or dimensions of these passageways in the cover plates.

One advantage of the present invention is that material can be added to the arc heated gas stream without additional downstream admission rings and seals. A second advantage of the invention is that by changing manifold cover plates, the direction in which the material being added enters the flow path of the arc heated gas steam can be varied from sheet flow to a turbulent swirling. Another advantage is that a material of a different nature can be added to and react with the high temperature arc heated gas to form a desired product. A further advantage is that the added material has a temperature which is substantially less than that of the arc heated gas and when this colder material is introduced to form the boundary layer the thermal and erosive damage caused by the arc heated gas to the passageways through the heating vessel is minimized. In addition, this boundary layer of gas prevents the build-up of undesirable materials on these passageways by either scrubbing the wall or reacting chemically with this built-up material.

The preferred embodiments described hereinabove are illustrative of the invention and should not be interpreted in a limiting sense.

We claim:

1. An electric arc heater apparatus, comprising:

means defining an arc chamber having an outlet therefrom and including a pair of axially spaced, substantially cylindrical hollow electrodes forming a narrow gap therebetween and adapted to be connected to a source of electrical potential to produce an electric arc therebetween;

insulating means for spacing and electrically insulating the electrodes from each other and including a ring having means for channeling a gas to be heated at a high velocity into the gap between the electrodes with the gas being heated by the electric arc formed in the arc chamber when the electrical potential is applied to the cylindrical electrodes;

mounting means disposed about the outlet of the arc chamber for attaching the electric arc heater to a reaction vessel having an opening such that substantially all the arc-heated gas is transferred into the reaction vessel therethrough, the mounting means including a flange having a mating face adjacent the reaction vessel and circumscribing the outlet with the mating face of the flange having a channel circumferentially extending about a substantial portion thereof, the flange having means therein for conducting into the channel a material to be added to the arc heated gas; and plate means detachably fastened to the flange such that the channel and plate means form a manifold for distributing the material about the outlet of the electric arc heater, the plate means including means for conducting the material from the manifold into the arc-heated gas exiting the outlet of the electric arc heater thereby minimizing thermal and erosive damage to the opening of the reaction vessel caused by passage of the arc-heated gas therethrough and providing for addition of the material to the arc-heated gas.

2. The apparatus as described in claim 1 wherein the means for conducting the material from the manifold into the arc-heated gas further comprises means forming a plurality of peripherally spaced passageways intermediate the manifold and the arc-heated gas and communicating therebetween, the passageways providing a substantially uniform distribution of the material into the heated gas.

3. The apparatus as described in claim 2 wherein plurality of peripherally spaced passageways are dimensioned such that the flow of the material therethrough is at substantially sonic velocity.

4. The apparatus as described in claim 2 wherein the plurality of passageways is formed to provide for introduction of the material in a direction which is generally tangential with respect to the flow of the arc-heated gas thereby aiding mixing of the material with arc heated gas.

5. The apparatus as described in claim 4 wherein the plurality of peripherally spaced passageways are dimensioned such that the flow of the material therethrough is at substantially sonic velocity.

6. The apparatus as described in claim 2 wherein the plurality of passaegways is formed to provide for the introduction of the material in a direction which is generally parallel with respect to the flow of the arc heated gas whereby such parallel introduction forms a boundary layer intermediate the arc heated gas and the opening through the reaction vessel thereby minimizing thermal or erosive damage caused by the contact of the arc heated gas therewith.

7. The apparatus as described in claim 6 wherein the plurality of peripherally spaced passageways are dimensioned such that the flow of the material therethrough is at substantially sonic velocity.

8. An electric arc heater apparatus, comprising:

means defining an arc chamber having an outlet therefrom and including a pair of axially spaced, substantially cylindrical hollow electrodes forming a narrow gap therebetween and adapted to be connected to a source of electrical potential to produce an electric arc therebetween;

insulating means for spacing and electrically insulating the electrodes from each other and including a ring having means for channeling gas to be heated at a high velocity into the gap between the electrodes with the gas being heated by the electric arc formed in the arc chamber when the electrical potential is applied to the cylindrical electrodes;

mounting means disposed about the outlet of the arc chamber for attaching the electric arc heater to a reaction vessel having an opening such that substantially all the arc-heated gas is transferred into the reaction vessel therethrough, the mounting means including a flange having an attachment face adjacent the reaction vessel circumscribing the outlet with the attachement face of the flange having a channel therein circumferentially extending about a substantial portion thereof, the flange having means therein for conducting a material into the channel;

annular plate means having an inner edge detachably fastened to the flange such that the channel and plate means form a manifold for distributing the material about the outlet of the electric arc heater, the annular plate means having a plurality of peripherally spaced passageways intermediate the manifold and the inner edge of the annular plate means; and the inner edge of the annular plate means having a lip projecting toward the channel and being spaced therefrom forming a substantially annular gap therebetween having a width substantially equal to the space between the lip and the channel when the annular plate means is fastened to the flange, the gap being disposed about the outlet with the width thereof controllingthe flow rate of the material from the manifold through the passageways and into the electric arc-heated gas, the gap providing the substantially uniform distribution of material into the electric arc-heated gas.

9. The apparatus as described in claim 8 wherein the annular gap has a width allowing for the flow of material therethrough at substantially sonic velocity.

10. The apparatus as described in claim 8 wherein the annular gap, which is formed between the annular plate means and flange, has a substantially L-shaped cross section such that the material passing therethrough enters the flow of the electric arc heated gas in a direction generally parallel thereto forming a boundary layer about the electric arc-heated gas.

11. The apparatus as described in claim 10 wherein the annular gap has a width allowing for the flow of the material therethrough at substantially sonic velocity.

12. The apparatus as described in claim 8 wherein the plurality of peripherally spaced passageways are formed such that the material passing therethrough and exiting the annular gap enters the flow of the electric arc heated gas in a direction which is generally tangential thereto.

13. The apparatus as described in claim 12 wherein the annular gap has a width allowing for the flow of the material therethrough at substantially sonic velocity.

* * * * *